US005348501A

United States Patent [19]

Brown

[11] Patent Number: 5,348,501

[45] Date of Patent: Sep. 20, 1994

[54] COMPACT RETRIEVABLE MARKER BUOY

[76] Inventor: Steven J. Brown, 1805 Fredith La., Topeka, Kans. 66618

[21] Appl. No.: 7,618

[22] Filed: Jan. 22, 1993

[51] Int. Cl.[5] ..... B63B 21/52

[52] U.S. Cl. ..... 441/2; 441/6; 441/26; 441/28

[58] Field of Search ..... 441/1, 2, 6, 7, 21, 441/22, 23, 24, 25, 26, 27, 28, 29

[56] References Cited

U.S. PATENT DOCUMENTS

| | | | |
|---|---|---|---|
| 1,993,974 | 3/1935 | McVicker | 441/26 |
| 2,562,922 | 8/1951 | Kist . | |
| 2,586,828 | 2/1952 | Keeran | 441/22 |
| 3,199,070 | 8/1965 | Baier, Jr. . | |
| 3,626,528 | 12/1971 | Jackson | 441/6 |
| 3,653,085 | 4/1972 | Rovner | 441/23 |
| 3,722,014 | 3/1973 | Hill et al. . | |
| 4,074,380 | 2/1978 | Parker | 441/26 |
| 4,262,379 | 4/1981 | Jankiewicz | 441/23 |
| 4,300,254 | 11/1981 | Prior | 441/28 |
| 4,443,203 | 4/1984 | Maertens | 441/26 |
| 4,834,684 | 5/1989 | Tallerino | 441/2 |
| 5,003,514 | 3/1991 | Cotilla et al. | 441/2 |
| 5,100,353 | 3/1992 | Domborwski et al. | 441/6 |

FOREIGN PATENT DOCUMENTS

| | | | |
|---|---|---|---|
| 9102676 | 3/1991 | PCT Int'l Appl. | 441/2 |

*Primary Examiner*—Stephen P. Avila
*Attorney, Agent, or Firm*—Bruce J. Clark

[57] ABSTRACT

A compact, retrievable and inexpensive marker buoy has a primary housing in the shape of an hourglass having a throat in the center, and a base. The primary housing has a waterproof chamber situated closer to one end than the other and a non-waterproof chamber at the opposite end. A lid at one end provides access to the waterproof chamber, which chamber contains an unattached battery, a signal receiving device, and an electrical device which are linked to a releasably attachable hook. The base has a corresponding device attached to the hook. A tether is connected from the base to the primary housing unit. A transmitter transmits the necessary command signal to the receiver from above the water.

5 Claims, 3 Drawing Sheets

COMPACT RETRIEVABLE MARKER BUOY

BACKGROUND OF INVENTION

This invention relates to submersible retrievable marker buoys for use in marking underwater Locations for relatively short periods of time and in relatively short depths of water.

It is often desired, for both recreational, scientific and other purposes, to mark a location in a pond, lake or ocean, for ease of relocating the position at a later time. It is also often desirable in such cases, instead of placing the marker buoy in a position so as to float on the water tethered to an anchor, to instead sink a marker buoy assembly to the floor or the body water and at a subsequent Lime, upon a remote command, release the buoy portion of the: assembly to the top, tethered to the base below.

However, the prior art is mostly directed to deep sea marking buoys or other buoys that are often large or cumbersome, often as large as a 55 gallon drum, which are both expensive and in some cases, particularly those using explosive releasing mechanisms, dangerous and potentially environmentally harmful. Moreover, many of the marker buoys are directed to being underwater for longer periods of time, thus requiring special batteries or circuits, anti-corrosive precautions, and the like. However, there is a need for a transportable, compact, inexpensive and reliable marker buoy for use in relatively shallow body of water, i.e., a pond, lake or shallow parts of the ocean, as opposed to deep sea ocean, and for relatively short periods of time, for purposes of fishing and other recreation, as well as for scientific or educational purposes. In these instances, it is usually only necessary to mark the location for anywhere from a matter of minutes to a matter of days. Long-term marking is not necessary.

It is thus an object of this invention to provide an inexpensive, compact, relatively small, convenient, transportable and reliable submersible marker buoy t or relatively short term submersion in lakes, ponds and shallow ocean. It is further an object of this invention to provide an economical, easy to use submersible marker buoy assembly with a tethered buoy released upon remote command such that the tethered buoy reliably unwinds.

Other objects and features of tile invention and objectives and the manner in which the invention achieves its purpose will be appreciated from the foregoing and the following description and the accompanying drawings which exemplify the invention, in being understood that changes may be made in the specific invention disclosed herein without departing from the essentials of the invention set forth in the appended claims.

BRIEF SUMMARY OF INVENTION

This inventions relates to a submersible fishing marker buoy having an hourglass-shaped rigid casing, with a separate base, said casing having a top end and bottom end with diameters larger than the diameter at the center and continuous, smooth tapering from the ends to the center, to a smaller radius center, with all parts the casing symmetrical about a longitudinal axis extending from the top end to the bottom end, a removable lid enclosing a waterproof casing; enclosed in the casing is a receiver/actuator mechanism with a battery source for receiving external command signals; the actuator means are connected to releasable hook means engaged to a base hook, which base hook is affixed to a separate mooring base sufficiently heavy to retain the entire assembly at the floor of the body of water. The base is tethered to the casing.

DESCRIPTION OF THE PREFERRED EMBODIMENTS

Figure 1:
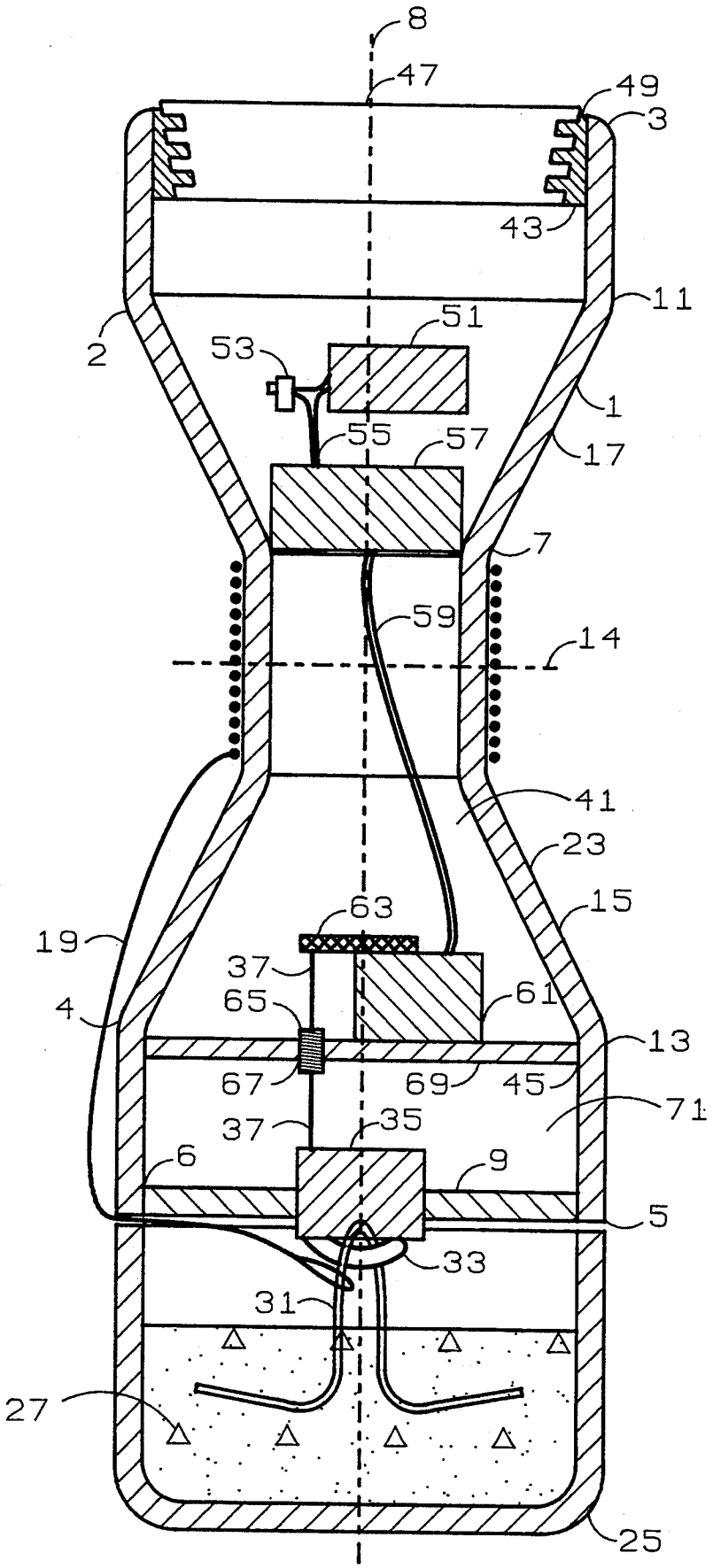
FIG. 1 is a cut away side view of the invention.

FIG. 1 shows the invention in its preferred embodiment comprised of a primary housing and a base. The primary housing has an outer casing 1 having substantially the hourglass shape represented by the casing 1. However, the principal requirements of the shape are that the end 3 and bottom end 5 are larger in comparison to the throat 7, and flanged to the throat, i.e., the casing is smoothly but not necessarily linearly tapered from the ends to a smaller center. The flange points 2, 4, 11, and 13 are rounded and smoothed. The entire primary housing is tubular with varying diameters between the top and bottom. The resulting shape between the flange points 11, and the throat 7 is, in the preferred mode, generally conical. The bottom end 5 is closed with a bottom plate 9 so that it is not necessary that the bottom end chamber 71 be watertight where the plate 9 and the outer casing 1 meet. In fact, in the preferred mode, the chamber 71 will hold water when the unit is submerged. The casing at the top end 1 and bottom end 5 are preferably circular at the flange points 11 and 13, in combination with the constantly circular but reducing radius flange faces 15 and 17, and allow reliable unwinding of the buoy as it floats to the top o the surface of the water, and reduce substantially the likelihood of snagging and tangling during unwinding of the tether 19. The radius and diameters referred to herein are measured in relation to the imaginary longitudinal axis 8 extending from the center or, the top end to the center of the bottom end. Therefore, it is imperative that the buoy casing 1 be circular between flange points 11 and 13 with the radii at 11 and 13 larger, although not necessarily equal to each other, than the radius at the throat 7. The radii between 11 and 13 are variable, although not necessarily linearly variable. For ease in handling and convenience, it is preferred that the radius of the buoy casing at the top end 3 be equal to or less than the radius at flange point 11. Likewise the radius at the bottom end should be equal to or less than the radius at the flange point 13 in the preferred mode. The radius of the throat, in the preferred mode, is approximately one-half of the radius at the flange points 11 and 13. The shape of the casing is substantially symmetrical on either side of the imaginary axis 14 extending through the center equidistant between the two ends. In this manner with these dimensions, the primary housing is seen as having a shape primarily tubular, with variable diameters and is most convenient to handle, store and use, and most reliably unwinds when floating to the top.

The material 23 of the buoy casing is strong, rigid and buoyant, preferably plastic. Buoyancy here refers to positive buoyancy. PVC pipe is one preferred material. The base 25 can be one solid piece or it can be made from the same tubing having the same radius as that at the bottom end 5. In the latter case, the material 27, such as concrete or other heavy material, is sufficiently heavy to allow the base to sink and stay on the bottom of the lake during the time the buoy 1 is connected or tethered to it. A rigid but firm hook element 31 is permanently secured in the heavy material 27. A hook 33 is hinged to and part of a mechanical releasable hook assembly 35 fixed to the bottom plate 9. In use, the hook 33 is inserted through the base hook 31. The hook assembly 35 is such that the hook is spring loaded and such that in response to a pull upward from the string 37, the hook 33 is released to spring back completely within the hook assembly 35, thus releasing the connection between the hook 33 and base hook 31, allowing the buoy 1 to begin floating to the top and unwinding. Although hook and string means are shown as the attachment and linkage means, respectively, any means, mechanical or electrical is envisioned. A hole or plug 57 is not necessarily required in other modes. Magnetic linkage, as well as attachment means, for example, is possible. The tether 19 is connected at the throat at one end and at the base hook 31 at the other. Buoyancy is facilitated by a waterproof chamber 41 created between top seal 43 and bottom seal 45. In the preferred mode, more of the chamber 41 is located near the top end then the bottom end, to facilitate proper positioning when floating on top of the water. A lid 47 is removable and in the preferred mode threaded to match the threaded rubber gasket 49 at the top end 3. This removable lid can be of the type commonly available for use with PVC piping, as is the threaded rubber gasket 49.

In the airtiqht chamber 41 is he battery or power supply 51. The battery supply is switched at the switch 53 to preserve battery power when the device is not in use. The power supply wires 55 connect the power to the command signal receiver 57, which in the preferred mode is a radio frequency receiver (or some other frequency) tuned to match a corresponding frequency transmitter which transmits the appropriate signal from above water to the receiver 57 as desired. The receiver then signals the electromechanical device 61 via wires 59 to raise the lever arm 63, thus pulling the string 37 and as indicated earlier, releasing the hook 33 from the base hook 31 via mechanical releasable hook assembly 35. Other electromechanical means are envisioned for releasing the hook as are other means for releasably connecting the base to the primary housing. The command receiver 57 is likewise secured to the walls within the airtight chamber 41.

The watertight area 41 is further maintained by use of a P&T plug like that used in the plumbing industry 65, threaded at which device is made to allow a string or other linkage means to pass through while maintaining airtightness or watertightness. The plug in 65 is similar to a model BNE 0.025, Sisco Brans, made specifically to preserve air and watertightness. The plug is secured in the bottom sealed plate 69. Affixed to the plate in the chamber 41 is the electromechanical device 61.

The battery wire 55 is long enough to allow the battery assembly 51 and the switch 53 to be removed a sufficient distance outside the top end 3 to allow for easy access and replacement. In the preferred mode the batteries are left unattached and free to move within the chamber 41 such that as the device rolls, the batteries relocate. The chamber 71 in the preferred mode takes on sufficient water to provide ballast sufficient to offset the weight of the batteries at the other end, further facilitating the horizontal positioning of the primary housing unit as it floats to the top to facilitate reliable unwinding. The relative size and positions of the chambers 41 and 71 are as shown in FIG. 1, or the preferred mode. However, in other modes, it is significant or reliable unwinding that the chamber 71 be of a sufficient size to take on the water sufficient to create the necessary ballast at the the bottom end to offset the weight of the batteries in the top end, to allow the device to be substantially horizontal when submerged and floating to the top.

Figure 2:
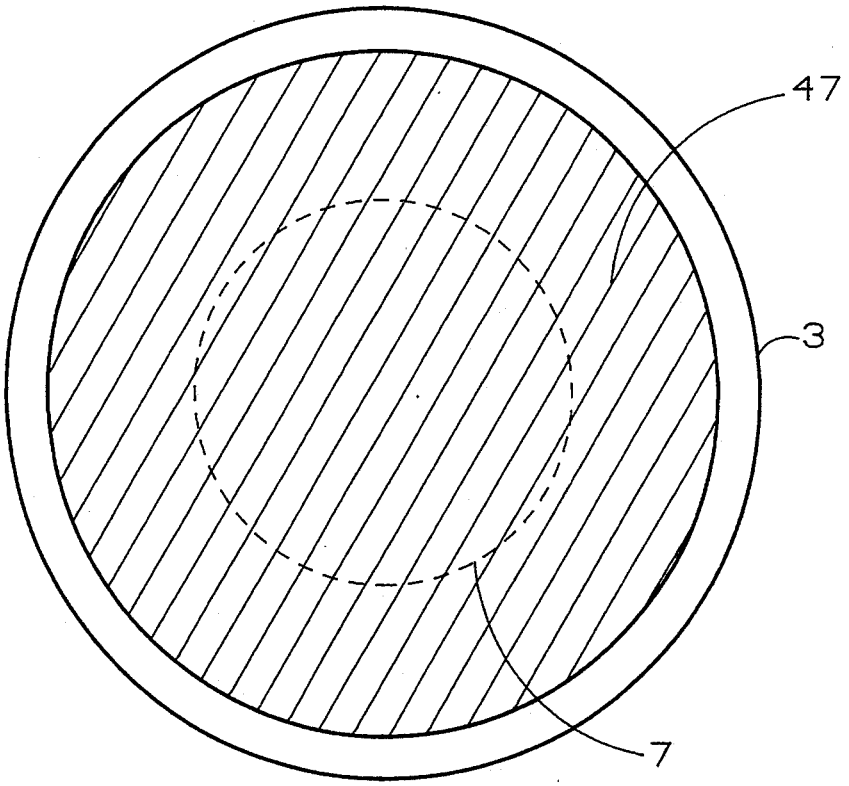
FIG. 2 is a top view of the invention.

FIG. 2 is the top end birds eye view showing the lid 47. The throat 7 is also shown in dotted lines to illustrate the preferred relationship of the circumferences.

Figure 3:
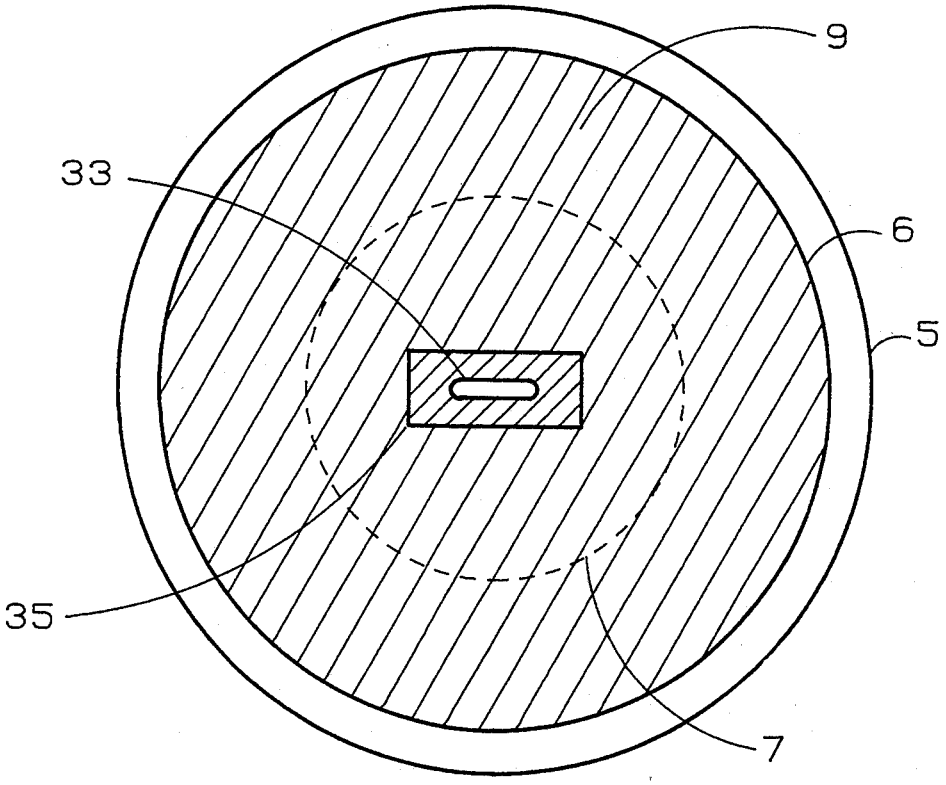
FIG. 3 is a bottom view of the invention.

Likewise, in FIG. 3, a bottom at 5 is shown. The circumference of the throat 7 is shown in dotted lines. Also shown is the base plate 9 connected to the buoy casing at 6. Also shown is the hook assembly 35 and hook 33, within. The base plate 9 and the buoy casing 6 need not be separate and could be all one piece.

Figure 4:
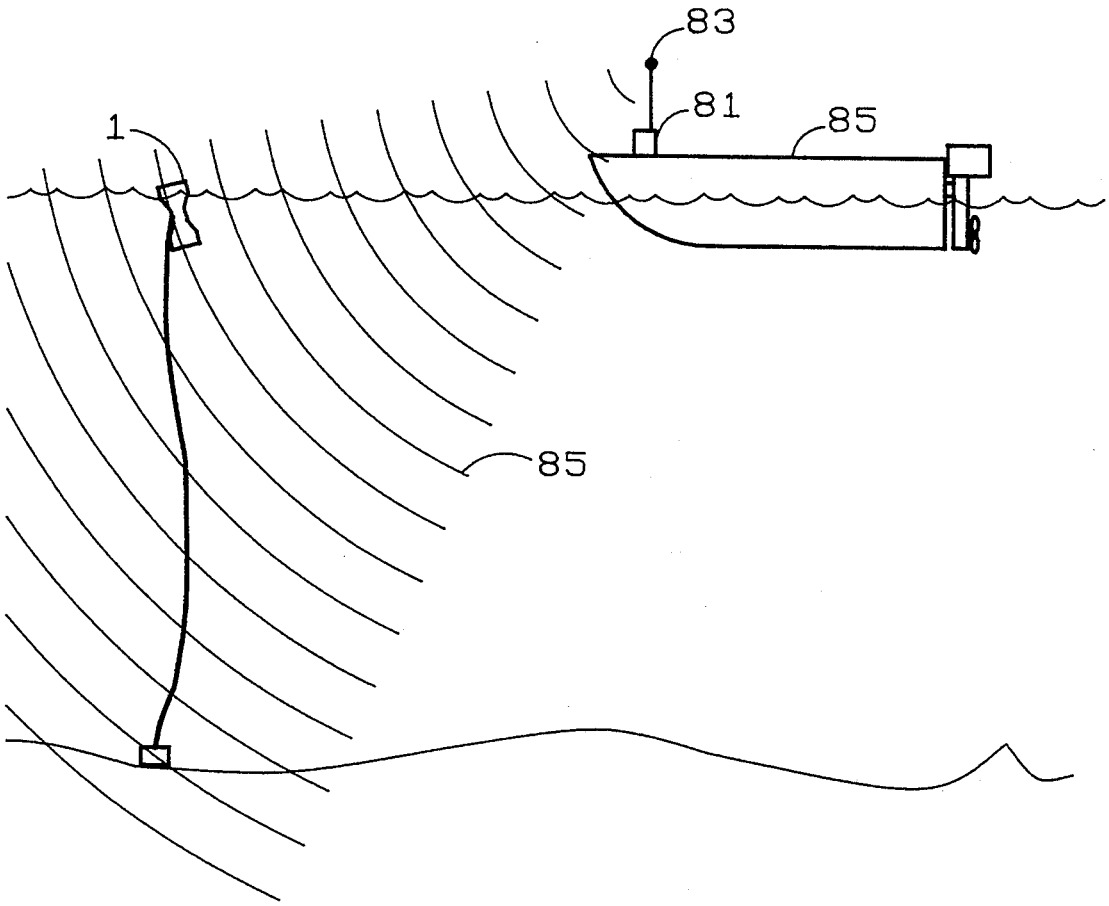
FIG. 4 shows the invention in use.

In use, as shown in FIG. 4, a transmitter 81, preferably with antenna 83, transmits through radio waves 85 a coded signal recognizable at a corresponding frequency by the receiver 57. The hook is released and the buoy portion 1 floats toward the top, reliably unwinding. Further facilitating the unwinding is the fact that the weight of the batteries and other devices at the top end 3 of the buoy 1 force that end lower into the water. This also allows the bottom end 5 to stand more upright in the water for more easy recognition from the boat 85. It should be understood that any remote method of communication between the transmitter 81 and the receiver 57 is envisioned, including the use of sonic control instead of radio frequency control. In such case the transmitter would more likely be placed in the water or have its antenna in the water near the boat. The receiver 57 would be tuned to receive sonic frequencies.

As an additional feature, to avoid losing the device should the batteries lose their power while the assembly is underwater, a low battery dectector may be connected in the circuit such that a low battery signal in the wires 55 will result in the emission of a voltage signal sufficient on wires 59 to trigger the electromechanical mechanism 61 to ultimately release the hook 33 from the base hook 31. In this manner, when the batteries lose sufficient power, the buoy automatically floats to the top.

The transmitter and receiver can be the simple remote control transmitters and receivers used with toy cars, consequently allowing for inexpensive devices to be utilized; however, because of the limited range of the radio frequency signals, the device is not as suitable for deep ocean purposes. Likewise, the electromechanical switch 61 and hook assembly 35, as well as the plug 65 and the PVC parts, are commonly available and together create, in the mode described, an inexpensive retrievable buoy marker assembly.

While there have been shown and described particular embodiments of the invention, it will be obvious to those skilled in the art that changes and modifications may be made without departing from the invention or its equivalent, and, therefore, it is intended by the appended claims to cover all such changes and modifications as fall within the true spirit and scope of the invention.

I claim:

1. A submersible, retrievable, fishing marker buoy having a base portion and a marker portion, for marking a desired location in a body of water, such that the marker portion can sit on the floor of a body of water prior to receiving an external command signal, said buoy comprised of:

a primary housing comprised of a tubular rigid casing having a top end and a bottom end, a waterproof chamber within the casing, and a watertight wall separating the waterproof chamber from the external non-waterproof areas;

a removable lid that allows access to the waterproof chamber;

electrical/mechanical receiver/actuator means having an electrical receiver portion and a mechanical-/actuator portion, located in the waterproof chamber for receiving external command signals and such that upon receiving said signals an internal control signal is generated to energize the mechanical actuator so as to physically move the actuator;

a separate mooring base sufficiently heavy to retain the housing at the floor when the housing is connected to the base;

releasable connecting means connected to the bottom end of the marker portion and to the mooring base such that the housing is releasably connected to the mooring base;

coupling means through the watertight wall and physically connecting the receiver/actuator means within the waterproof chamber to the releasable connecting means such that the housing is released from the mooring base in response to the internal control electrical signal;

tethering means attached from the base to the primary housing;

battery means within the watertight chamber for electrically powering the receiver/actuator means;

corresponding transmitter means for transmitting the command signal to the receiver/actuator means.

2. The marker buoy in claim 1 wherein the tubular casing has a top end with a center, a bottom end having a center, and wherein the tubular casing has an outer shape defined by a range of radii along an imaginary longitudinal central axis extending from the top end center to the bottom end center, with the largest radius near the top and bottom ends and tapering from the two ends to a smaller radii at the center of the axis midway between the top end center and the bottom end center.

3. The marker buoy in claim 1 wherein the electrical-mechanical receiver/actuator means is comprised of electrical-mechanical means having an actuator arm capable of having at least two physical positions in response to an electrical signal, said electrical/mechanical receiver/actuator means located within the waterproof chamber, hook receiving means affixed to the base and releasable connecting means comprised of springloaded hook means affixed to the bottom end to which the coupling means connected so as to allow the hook means to be released in response to a pull on the said releasable connecting means, and wherein said coupling means is comprised of a linking means having a first and second end, said first end connected to said actuator arm, and extending through the plug means such that the second end is attached to the releasable connecting means so as to supply the necessary pull to release the springloaded hook in response to an electrical signal present at the receiver/actuator means.

4. The marker buoy in claim 1 wherein the waterproof chamber within the tubular casing is located closer to the top end than the bottom end and having a non-waterproof cavity located near the bottom end and of a sufficient size to hold water necessary to counterbalance the weight of the batteries in the waterproof cavity so as to allow sufficient buoyancy to create a substantially horizontal position of the primary housing when submerged during unwinding.

5. The marker buoy in claim 1 having a low battery detector circuit means electrically connected to the electrical-mechanical means such that an internal command signal is generated when the level of battery power reaches a certain predetermined low level so as to release the hook means and thus release the primary housing.

* * * * *